US005577823A

United States Patent [19]

Maglinger

[11] Patent Number: 5,577,823

[45] Date of Patent: Nov. 26, 1996

[54] LAZY SUSAN TYPE PAN/CARRIAGE ASSEMBLY

[75] Inventor: Frank W. Maglinger, Evansville, Ind.

[73] Assignee: Whirlpool Corporation, Benton Harbor, Mich.

[21] Appl. No.: 505,432

[22] Filed: Jul. 21, 1995

[51] Int. Cl.[6] ..... F25D 11/00; A47B 88/00

[52] U.S. Cl. ..... 312/404; 312/308; 312/408

[58] Field of Search ..... 312/298, 308, 312/404, 408, 410

[56] References Cited

U.S. PATENT DOCUMENTS

| | | | |
|---|---|---|---|
| 1,899,372 | 2/1933 | Walter | 312/408 X |
| 1,914,767 | 6/1933 | Beckwith | 312/308 |
| 2,035,226 | 3/1936 | Forsthoefel . | |
| 2,692,811 | 10/1954 | Page | 312/308 |
| 2,795,474 | 6/1957 | Carbary . | |
| 2,799,285 | 7/1957 | Lines . | |
| 2,813,635 | 11/1957 | Schumacher . | |
| 3,177,047 | 4/1965 | Mutchnik | 312/308 |
| 5,056,332 | 11/1991 | Tajima et al. . | |
| 5,273,354 | 12/1993 | Herrmann et al. | 312/408 |
| 5,277,486 | 1/1994 | Bustos . | |
| 5,277,488 | 1/1994 | Cleary et al. . | |
| 5,362,145 | 11/1994 | Bird et al. | 312/410 X |

FOREIGN PATENT DOCUMENTS

| | | | |
|---|---|---|---|
| 233711 | 5/1961 | Australia | 312/298 |

*Primary Examiner*—Milton Nelson, Jr.
*Assistant Examiner*—Hanh Tran
*Attorney, Agent, or Firm*—Thomas J. Roth; Mark A. Davis

[57] ABSTRACT

A lazy susan type pan and carriage assembly wherein the pan is rotatably supported by a carriage is provided. The carriage is also slidably supported beneath an adjustable cantilevered shelf. The pan and carriage may be pulled forward to extend beyond the shelf while the pan, supported by the carriage, may be rotated to allow easy access to the items stored within the pan. The pan is rotatably supported on rollers.

17 Claims, 5 Drawing Sheets

LAZY SUSAN TYPE PAN/CARRIAGE ASSEMBLY

BACKGROUND OF THE INVENTION

The present invention relates generally to appliances and more specifically to a lazy susan type pan and a carriage assembly for use in a refrigerator, for example.

Current refrigerator design incorporates many features that allow for easier access to products and items stored in a refrigerator. The emphasis is on ease of use and speed of retrieval of the items from the refrigerator so that the door does not remain open longer than necessary. This is an energy saving feature and a convenience feature for the user. A common problem with storage in refrigerators is the item that remains in the rear of the refrigerator which can sometimes become lost and remain in the refrigerator for an excess of amount of time. When this happens the item can actually spoil while in the refrigerator without the user even realizing it. Thus, a method of storage in a refrigerator is needed so that items are always accessible to the user.

A rotating shelf, commonly known as a "lazy susan" type shelf has been used in cupboards and on tables for providing easier access to items on the lazy susan for the user desiring the same. Various attempts to improve the convenience of a refrigerator and the storage methods used therein are disclosed in the following patents.

U.S. Pat. No. 5,273,354, discloses a cantilevered shelf 22 which slidably supports a storage bin 56. The shelf is cantilevered upon support brackets from the back wall of a refrigerator. Also, slide tracks are optionally provided on the support brackets for slidably receiving and supporting the storage bin or drawer beneath the shelf. However, this patent does not provide a rotating shelf.

U.S. Pat. Nos. 5,056,332 and 1,899,372 both disclose refrigerators having round shelves that are supported by rollers underneath the shelves. However, these shelves are not retractable nor do they extend toward the front portion of the refrigerator for easier access.

U.S. Pat. No. 2,035,226 discloses a refrigerator having a shelf 18 which is pivotably mounted on a support beam 27. However, this patent does not provide a fully rotating shelf pan that can pull out.

Thus, the need has arisen for a refrigerator having a lazy susan type pan and carriage assembly that is rotatably supported by a carriage. The carriage may be pulled forward to extend beyond the shelf while the pan, supported by rollers on the carriage, can also be rotated to allow easy access to the items stored within the pan.

SUMMARY OF THE INVENTION

The present invention provides a refrigerator having a lazy susan type pan and carriage assembly that is rotatably supported by a carriage. The lazy susan type pan is slidably supported beneath an adjustable cantilevered shelf. In this manner, the carriage may be pulled forward to extend beyond the shelf while the pan, supported by the carriage, may be rotated to allow easy access to the items stored within the pan. The pan is rotatably supported by rollers.

It is an object of the invention to provide a lazy susan type pan/carriage assembly to increase the accessibility of the articles of foods, etc., stored in the food storage compartment of the refrigerator.

Another object of the present invention is to provide a lazy susan type pan/carriage assembly in which the items stored in the pan are easily accessible. Thus, any desired article may, by extending the carriage and rotating the pan, be brought to a position at the front of the refrigerator where it can be easily withdrawn without interference from other articles and without requiring a rearrangement of any articles in the refrigerator.

Another object of the invention is to provide a lazy susan type pan/carriage assembly wherein the carriage firmly supports the pan loaded with food.

It is an object of the invention to provide a cantilevered roll-out pan in a refrigerator in which the pan is also capable of rotation. Another object of the present invention to provide a roll-out rotating pan that is a modular unit for use in a refrigerator.

It is another object of the present invention to provide a support ring on a lazy susan type pan that both locates and supports the pan within the carriage assembly, wherein front rollers which only locate and support the pan and back rollers which float to take up variations in the part allowances, are provided.

An advantage of the present invention is that it provides a convenient and simple-to-use lazy susan type pan for modular use in a refrigerator.

DETAILED DESCRIPTION OF THE PREFERRED EMBODIMENTS

Figure 1:
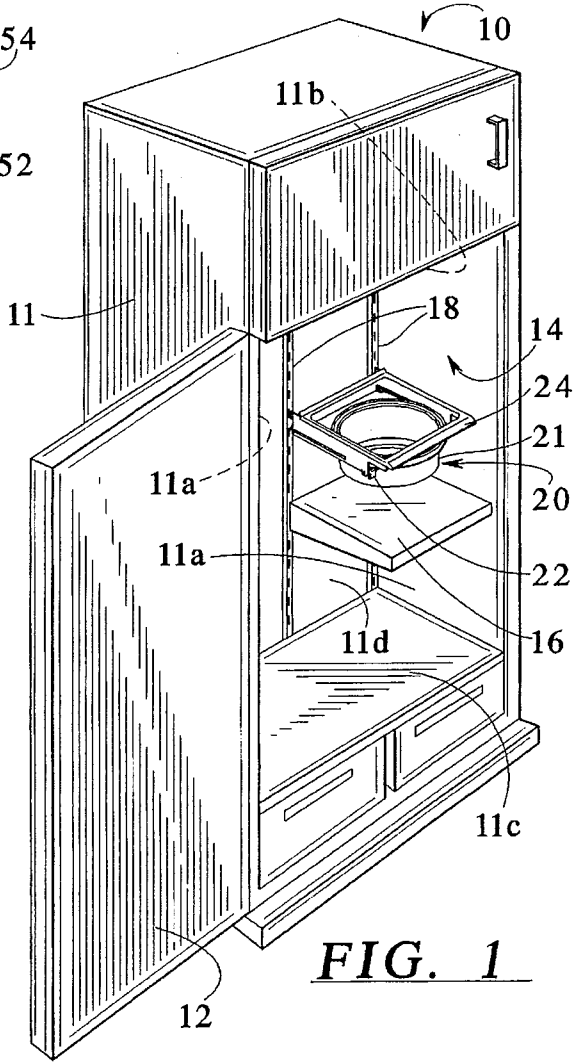
FIG. 1 illustrates a perspective view of a refrigerator in which the apparatus of the present invention is utilized.

FIG. 1 illustrates an appliance, specifically a refrigerator 10 comprising a cabinet 11 having sidewalls 11*a*, top wall 11*b*, bottom wall 11*c* and backwall 11*d* that define an interior compartment 14 closed by a door 12 that is used to enclose an interior compartment 14 in which produce, food and other items are stored. FIG. 1 also shows a shelf 16 within the interior compartment 14 of the refrigerator 10. The shelf 16 is mounted on mounting rails 18.

Figure 3:
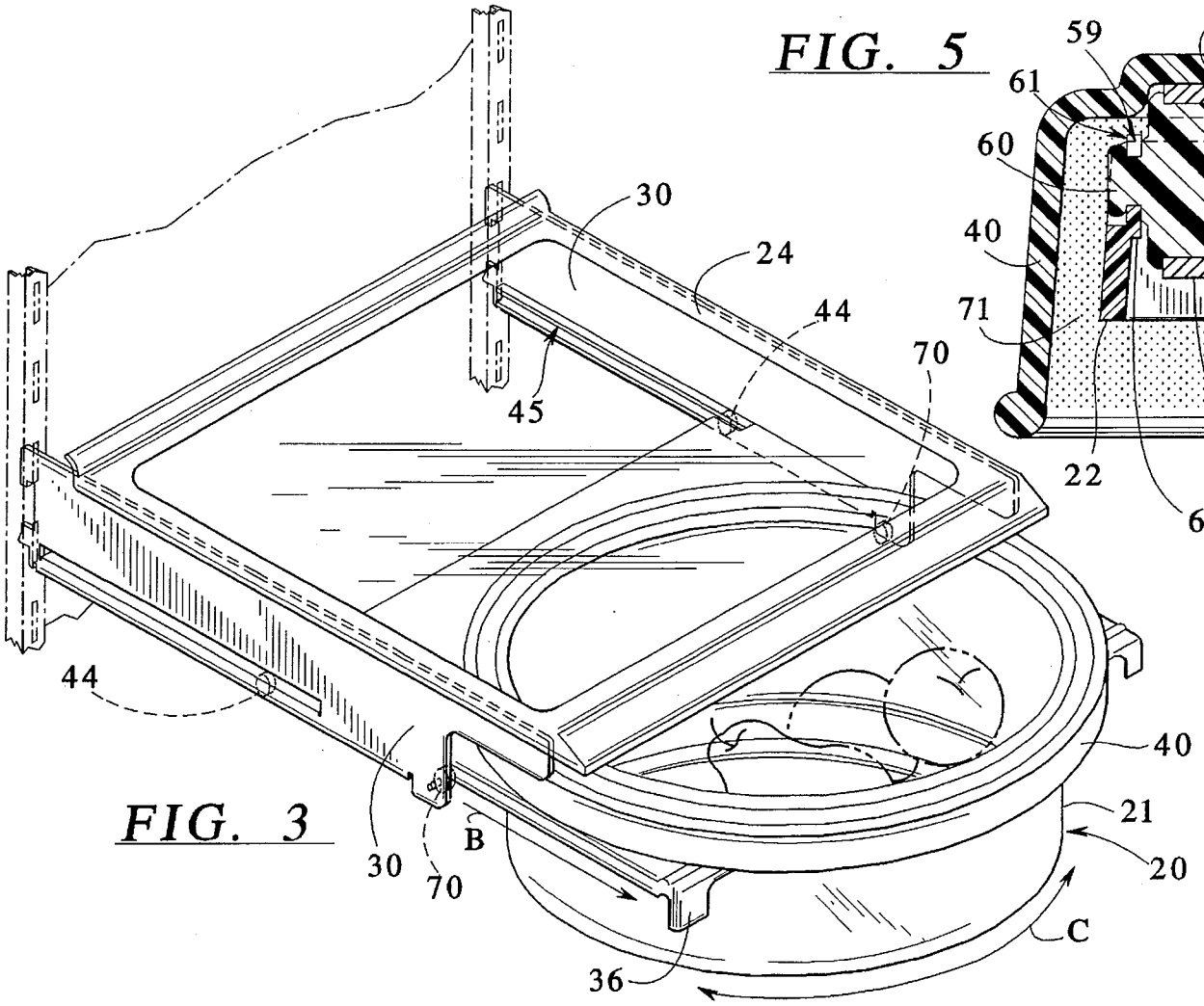
FIG. 3 illustrates an enlarged detail view of an embodiment of the present invention showing the operation thereof.

Also shown connected to the mounting rails 18 is an embodiment of the present invention comprising a lazy susan type container or pan 20 with a circular sidewall 21 supported by carriage 22 (shown in greater detail in FIG. 3). The carriage 22 is also slidably supported beneath an adjustable cantilevered shelf 24. The cantilevered shelf 24 is secured to the mounting rails 18 in the same manner that the shelf 16 is connected to the mounting rails 18.

Figure 2:
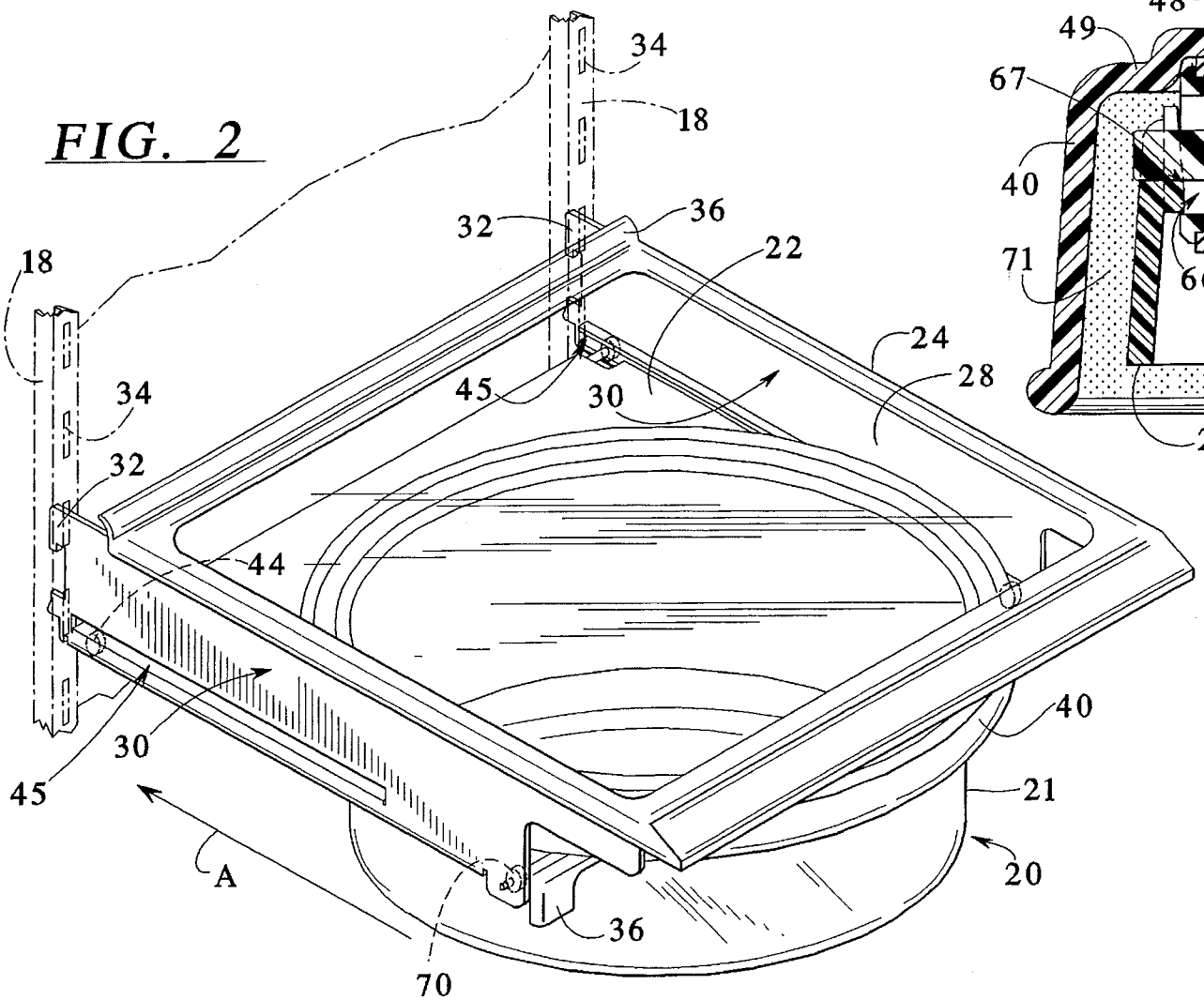
FIG. 2 illustrates an enlarged detail view of an embodiment of the apparatus of the present invention as utilized in the refrigerator of FIG. 1.

FIG. 2 illustrates an enlarged detail view of the apparatus of the present invention as shown in FIG. 1. For example, the rotating pan 20 is shown supported by the carriage 22 underneath the shelf 24. The shelf 24 preferably has a piece of clear glass 28 to provide the capability of viewing the items in the underlying pan 20. The shelf 24 is supported by a pair of shelf brackets 30. The shelf brackets 30 operate in a standard shelving technique by using a plurality of tabs 32 at the end thereof. The tabs 32 fit into slots 34 which anchor the brackets 30 and the shelf 24 to the mounting rails 18.

In addition, the shelf 24 has a retaining lip 35 on its back edge to prevent items and spilled liquids from falling behind the shelf 24. Also illustrated in FIG. 2 is a handle 36 on the carriage 22. This handle 36 is found on each side of the carriage 22 and provides a means for a user to pull or push to thereby pull out or push in the carriage 22. The handle 36 performs the additional function of acting as a stop so that the user does not overshoot the home position when moving the carriage 22 (see FIG. 9). Pulling the pan 20 out toward the user provides access to the items in the pan 20. In addition, a circumferential lip 40 is provided at the top of the pan 20. The user may also pull on this lip 40 to gain access to the contents of the pan 20. The user can also rotate the pan 20 by using the lip 40. To replace the pan 20 underneath the shelf 24, the user simply pushes on the handle 36 or the lip 40 in the direction of arrow "A" as shown in FIG. 2.

FIG. 3 illustrates a similar view to that shown in FIG. 2; however, the pan 20 supported by the carriage 22 is illustrated in a pulled out position. To achieve this position and thereby gain access to the products stored in the pan 20, the user pulls on the lip 40 or on the handle 36 in the direction of arrow "B". To obtain items located in the back of the pan 20, the user rotates the pan 20 in the direction of arrow "C", either to the right or to the left, as indicated. This can be done by grabbing the lip 40 and rotating the pan 20 in a desired direction.

Also, the carriage 22 translates on the brackets 30. The carriage 22 has a set of transport rollers 44 (described and shown in FIG. 9) for this purpose. Each of the transport rollers 44 travel on and within a travel channel 45 integrally formed in each of the brackets 30. The transport rollers 44 are thereby guided within the respective travel channels 45 to provide translational movement of the pan 20 and carriage 22. Thus, the pan/carriage assembly is capable of both translation and rotation.

Figure 4:
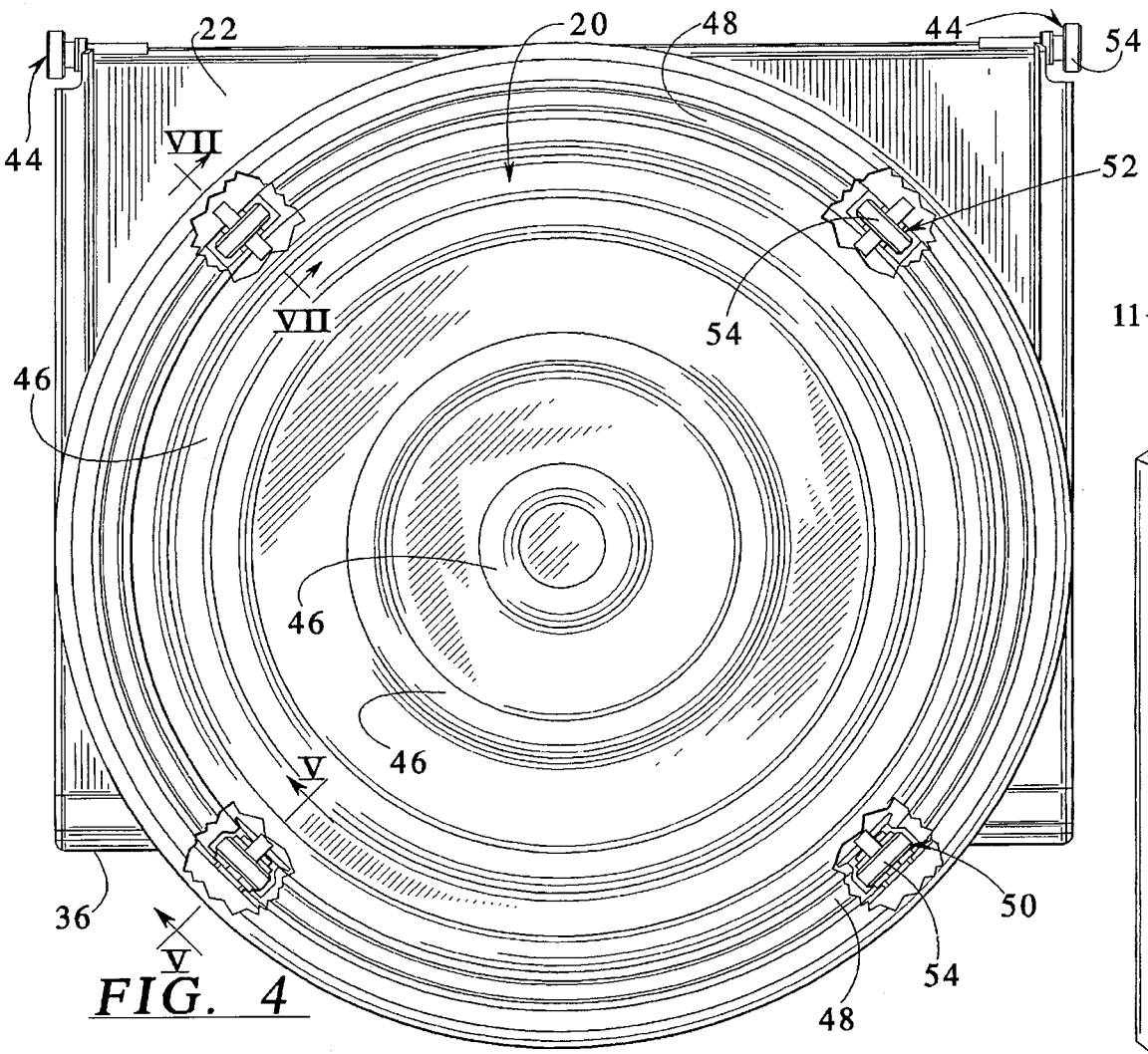
FIG. 4 illustrates a top view of an embodiment of the apparatus of the present invention.

A plan view of the present invention illustrating the carriage 22 and the pan 20, shown in partial cutaway, is illustrated in FIG. 4. Various details of the assembly are shown and will be described below. For example, the pan 20 has a plurality of raised concentric rings 46 which provide greater strength and rigidity to the pan 20. The rings 46 thereby provide for an increased storage capacity of the pan 20 without any extra support. The rings 46 also provide a stabilizing effect on products stored in the pan 20 to keep them from rolling around.

In a preferred embodiment, the pan 20 also has a support ring 48 formed in a rim 49 at the top of the circular sidewall 21 of the pan 20. A pair of front rollers 50 and a pair of back rollers 52 are mounted in the carriage 22 such that the pan 20 is supported on its support ring 48 and rides on top of the rollers 50, 52. In addition, each roller 44, 50, 52 has a rubber ring 54 located about its circumference to provide improved traction by virtue of the added friction of the rubber. For example, the support ring 48 rides directly atop the rubber ring 54 of each roller 50, 52. A more detailed description of the rollers, 50, 52 will now be discussed with reference to FIGS. 5–8.

Figure 5:
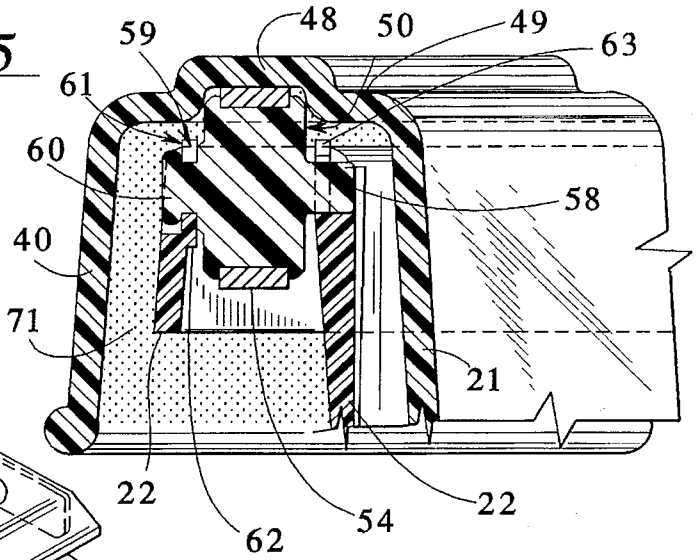
FIG. 5 illustrates a cross-section of an embodiment of a front roller of the present invention.

FIG. 5 illustrates a cross-section taken along section line V—V of FIG. 4. The lip 40 and rim 49 of the pan 20 are shown. A partial section of the pan 20 is shown having the support ring 48 located in the rim 49 thereof. The front roller 50 is illustrated with the rubber ring 54 located about its circumference. The front roller 50 also has an axle 58. At one end of the axle 58 is a groove 59 adjacent to a locating head 60.

Figure 6:
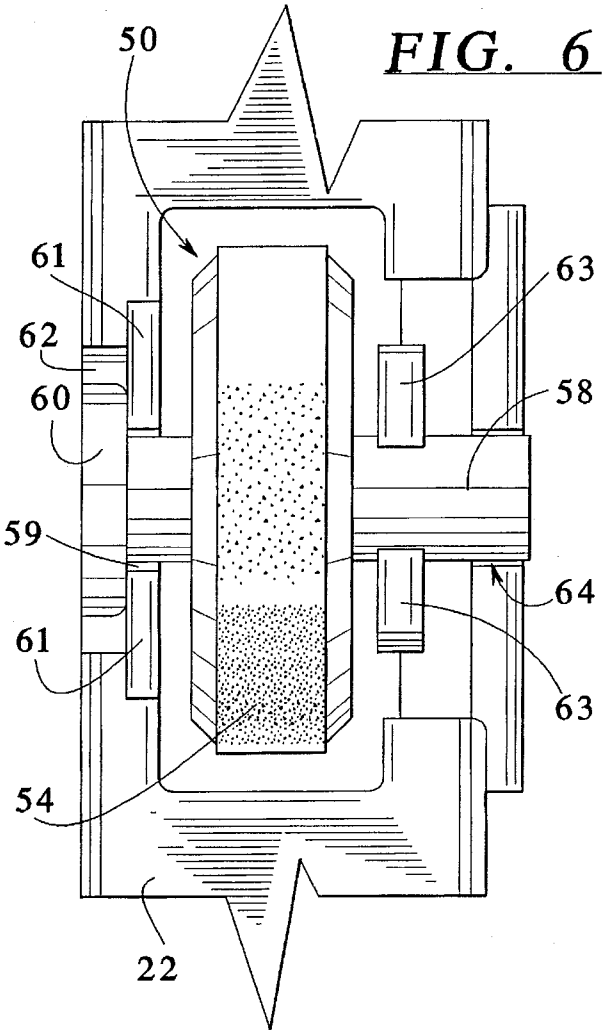
FIG. 6 illustrates an enlarged detail view of the front roller of the present invention shown in FIG. 4.

FIG. 6 shows the groove 59 in the front roller 50 fits within a locating tab 61 in the carriage 22. The locating tab 61 maintains the locating head 60 within a recess 62. The smallness of the groove 59 reduces shrinkage variation in the plastic construction of the parts of the invention so that a smoother rotating action, with very little slop of the front roller 50 within the locating tab 61, is provided. Thus, the front roller 50 reduces the locating mechanism to a finite area which minimizes shrinkage variation allowing for a good feel and fit of the apparatus.

The end of the axle 58 opposite the locating head 60 snaps vertically into a clamp 63 integrally formed with the carriage 22. Thus, the axle 58 is located in a recess 64 which keeps the axle 58 and the front roller 50 horizontally level.

Thus, the locating head 60, in conjunction with the clamp 63, provides a tight and relatively immobile connection for the front roller 50 in the horizontal direction. The snap-in connection of the front roller 50 in the clamp 63 is designed to be secure enough to provide proper rotation of the front roller 50 on the axle 58. In addition, the front roller 50 is removable from the clamp 63, given sufficient force, to allow for cleaning the roller 50.

As mentioned above, FIG. 6 shows an enlarged detail view of the front roller 50 of the present invention as illustrated in FIG. 4. The components of the clamp 63 that act to hold the axle 58 of the front roller 50 in place and provide for proper rotation of the front roller 50 are also indicated.

Figure 7:
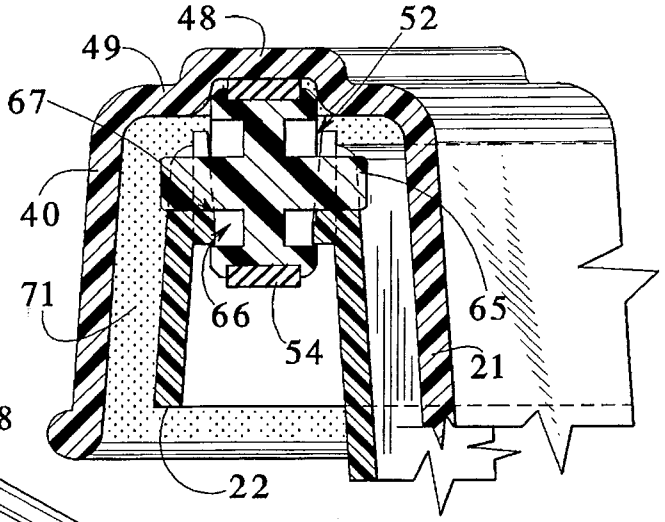
FIG. 7 illustrates a cross-section of an embodiment of a back roller of the present invention.

Now referring to FIG. 7 which is a cross-sectional view taken along section line VII—VII of FIG. 4 illustrates the back roller 52. The back roller 52 has the rubber ring 54 which is in contact with the support ring 48 of the pan 20. As illustrated, the back roller 52 has a different axle design than that of the front roller 50. For example, the back roller 52 has an axle 65 that does not have a locating head 60. Because of this difference, the back roller 52 is able to move horizontally to make up for variations found in the other parts of the assembly, i.e. the pan 20 and carriage 22. Thus, the back rollers 52 float approximately ±2 mm horizontally to compensate for any shrinkage variation between the bigger parts i.e. the pan 20 and the carriage 22.

Figure 8:
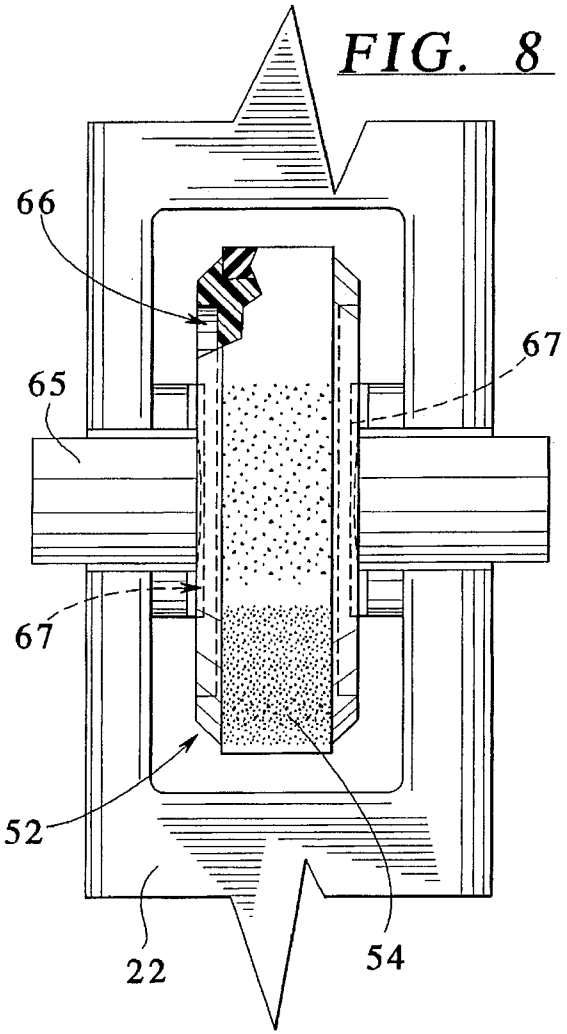
FIG. 8 shows an enlarged detail view of the back roller of the present invention shown in FIG. 4.

As shown in the enlarged detail of FIG. 8, the back rollers 52 have a cutout portion 66 that allows for this movement without increasing the size of the rim 49 of the pan 20. The cutout portion 66 also provides for snap together assembly without special clamps for the carriage 22. As shown in FIG. 7, the carriage 22 has a beveled clamp 67 for the snap together assembly of the back rollers 52. The back roller 52 is pressed into the ramped clamp 67, which narrows at the bottom until the cutout portion 66 is beneath the beveled clamp 67.

Thus, both pairs of rollers 50, 52 are supported on the carriage 22 to minimize mounting hardware. They merely snap into the carriage 22. Also, the carriage 22 supports the pan 20 from underneath the support ring 48 which maximizes the size of the pan 20. The pan 20 then rides on the rollers 50, 52 in the support ring 48 of the rim 49 of the pan 20.

Figure 9:
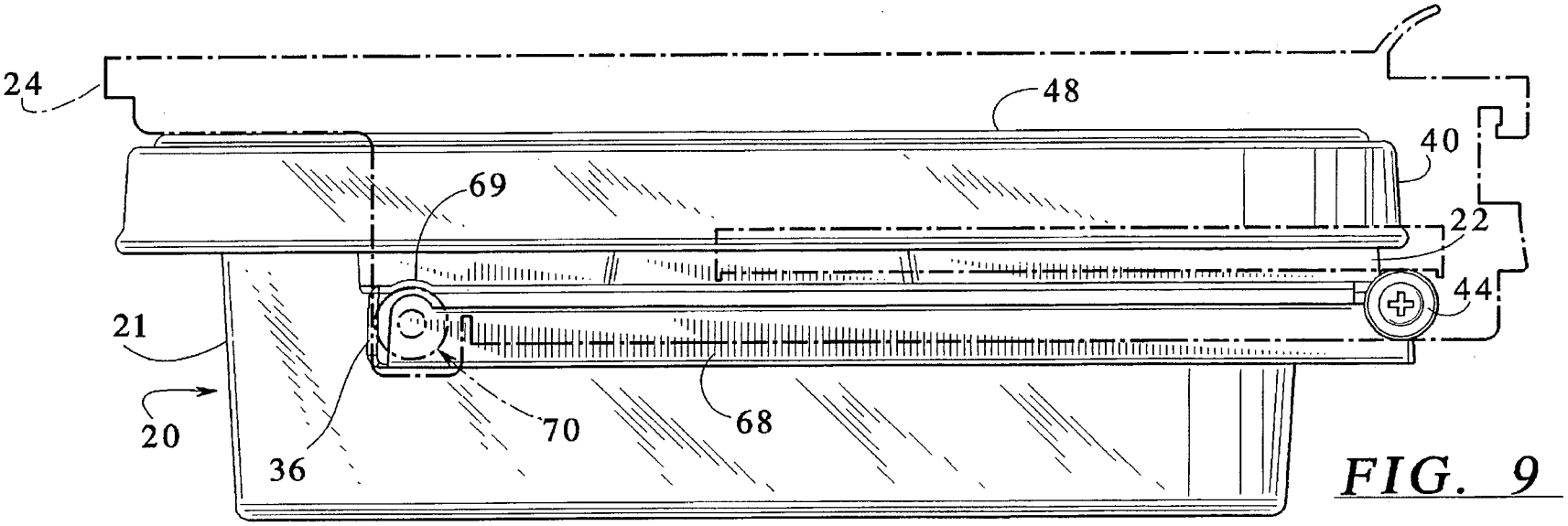
FIG. 9 illustrates a side view of an embodiment of the present invention.

FIG. 9 illustrates a side view of an embodiment of the present invention. The pan 20 and the carriage 22 are illustrated. In addition, the transport roller 44 is located as shown at the rear of the carriage 22. The carriage 22 also has a transport channel 68 located longitudinally along each side of the carriage 22. At the front end of the transport channel 68 is an indentation forming a roller stop 69. Thus, when the carriage 22, is pushed in by the handle 36, as illustrated in FIG. 2, in the direction of arrow A, a bracket-mounted transport roller 70 located on each bracket 30, which travels in the transport channel 68, will become seated in the roller stop 69. The pan 20 will then be securely held in a fixed position under the shelf 24 for proper storage when the refrigerator door 12 is closed. Thus, the handle 36 acts as a stop and also hides the transport roller 70 for a cleaner appearance.

As discussed above, there are two sets of roller paths in the present invention. As described, the pairs of rollers 50, 52 allow the pan 20 to rotate. In addition, rollers 44, 70 allow the carriage 22 to move in and out from underneath the shelf 24. These two sets of roller paths cannot intersect. As a result, two options exist for the location of the roller paths. First, the circular roller path can be inside the straight roller path, or secondly, the circular roller path can be stacked on the top of the straight roller path. The present invention incorporates the second option in which the circular roller path is stacked on top of the straight roller path which allows for more storage room. In addition, the front of the carriage 22 is cut back for greater access to the pan 20. Thus, with the front of the carriage 22 cut back and the carriage covered by the lip 40 of the pan 20, the pan 20 appears to be suspended with very little support. This also gives a clean look to the apparatus of the present invention.

Figure 10:
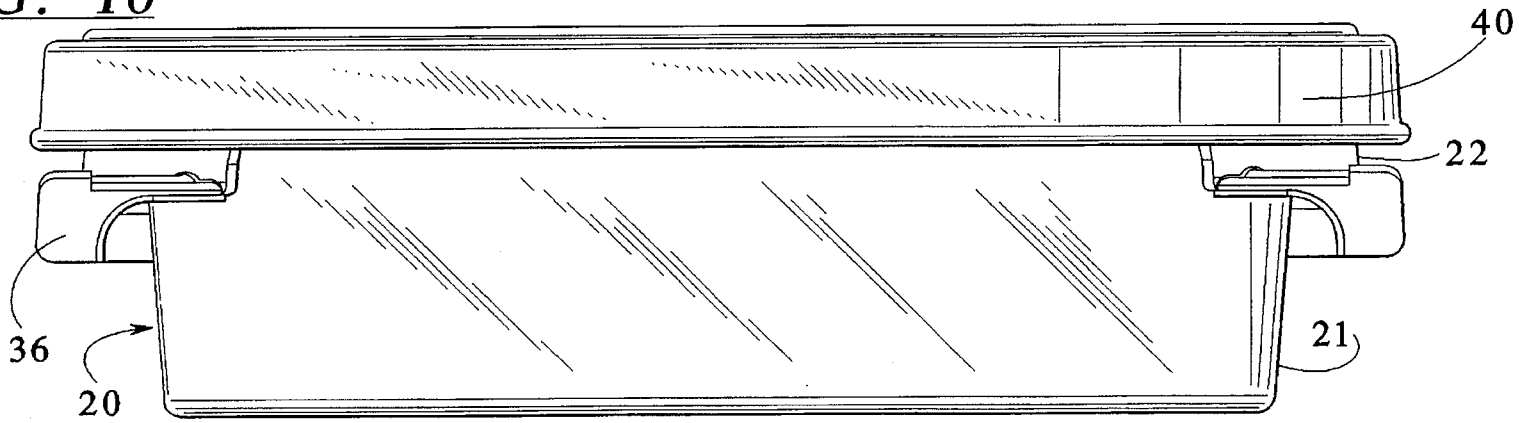
FIG. 10 illustrates a front view of an embodiment of the present invention.

FIG. 10 illustrates a front view of the pan and carriage assembly of the present invention. The handles 36 are positioned on each side of the carriage 22. As mentioned above, the user pulls or pushes on the handles 36 to translate the pan and carriage assembly. Also, the user may rotate or translate the pan 20 by easily grasping the lip 40 to spin or pull the pan 20.

Figure 11:
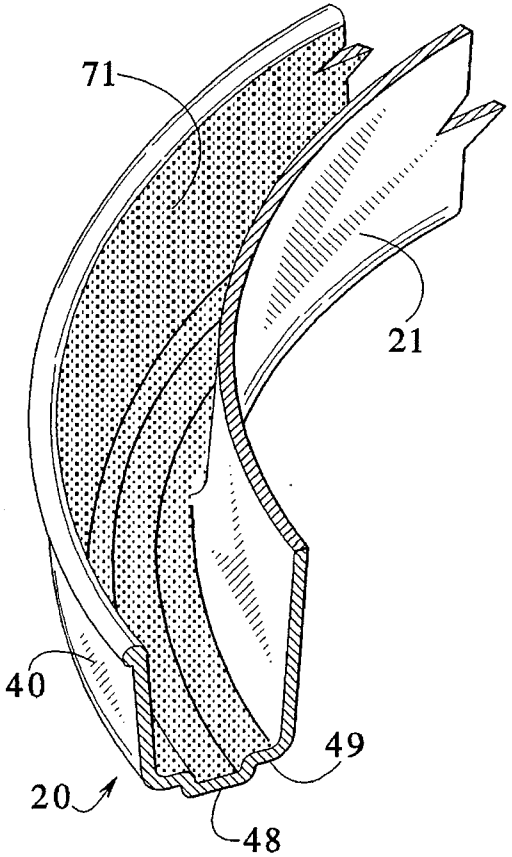
FIG. 11 illustrates a cross-sectional perspective view of an inverted pan of the present invention.

FIG. 11 is a cross-sectional perspective view of an inverted pan 20. In an embodiment, the pan 20 has a textured surface 71 on the inner part of the lip 40, the rim 49 and the support ring 48. This textured surface 71 has several purposes. First, it provides for better traction on the support ring 48. As shown in FIGS. 5 and 7, the textured surface 71 provides increased friction between the rubber ring 54 of each of the rollers 50, 52 and the support ring 48, thereby providing better traction and smoother operation. In addition, the textured surface 71 provides greater gripability for the user to spin the pan 20 by grabbing underneath the lip 40. Further, the textured surface 71 is also more impervious to scratches and provides a neater, cleaner appearance for the pan 20.

As is apparent from the foregoing specification, the invention is susceptible of embodiments with various alterations and modifications which may differ particularly from those that have been described in the proceeding specification.

It should be understood that we wish to embody within the scope of the patent warranted hereon, all such modifications as reasonably and properly within the scope of our contribution to the art.

The embodiments of the invention in which an exclusive property or privilege is claimed are therefore defined as follows:

1. A storage container apparatus capable of translational and rotational motion, comprising:

first and second support brackets;

a cover mounted to the first and second support brackets;

a carriage slidably mounted to the first and second support brackets for translational movement between a first and second position, the carriage having a circular aperture and being suspended beneath the cover;

a circular pan having a rim and the pan being disposed within the circular aperture such that the rim is rotatably supported by the carriage for rotation of the pan relative to the carriage;

wherein when the carriage is in the first position, the pan is fully covered by the cover, and when the carriage is in the second position, the pan is at least partially uncovered where it can be rotated to obtain access to the entire pan.

2. The container apparatus of claim 1, wherein each support bracket further comprises:

a roller located at a front end of each support bracket; and a guide rail formed in each support bracket; and wherein the carriage further comprises:

a longitudinal channel formed along the length of a first side and a second opposite side of the carriage such that the rollers of the first and second support brackets travel thereunder, respectively; and a first and a second carriage roller located on the first side and the second opposite side of the carriage, such that the carriage rollers travel on the guide rail of the first and second support brackets, respectively.

3. The container apparatus of claim 1, wherein the carriage further comprises:

a plurality of rollers located on a periphery of the circular aperture of the carriage, the plurality of rollers constructed and arranged to support the pan and to allow rotation of the pan thereon.

4. The container apparatus of claim 1, wherein the shelf cover is transparent glass.

5. The container apparatus of claim 1, wherein the first and second support brackets further comprise:

mounting tabs located at a rear end thereof.

6. The container apparatus of claim 1, wherein the carriage further comprises:

a detent located at a front end of the longitudinal channel on the first side and the second opposite side of the carriage.

7. A cabinet having a storage container capable of translational and rotational motion located therein, the cabinet further comprising:

a plurality of walls defining an interior compartment;

first and second support brackets secured to at least one of said walls;

a cover mounted to the first and second support brackets;

a carriage slidably mounted to the first and second support brackets for translational movement between a first and second position, the carriage having a circular aperture and being suspended beneath the cover;

a circular pan having a rim and the pan being disposed within the circular aperture such that the rim is rotatably supported by the carriage for rotation of the pan relative to the carriage;

wherein when the carriage is in the first position, the pan is fully covered by the cover and when the carriage is in the second position, the pan is at lease partially uncovered where it can be rotated to obtain access to entire interior of the pan.

8. The cabinet of claim 7, wherein said cover is cantilevered from one of the plurality of walls of the interior compartment.

9. A container apparatus comprising:

a circular pan having a circumferential rim located at the top of the pan;

said circumferential rim comprising a support ring located within the rim of the pan;

a first mounting bracket and a second mounting bracket, each bracket having at least one roller and an integral track formed therein;

a carriage having a circular aperture capable of accommodating the circular pan therein, the carriage including a first roller and a second roller constructed and arranged to travel on the integral track formed in the first mounting bracket and the second mounting bracket, respectively, to allow translational movement of the carriage therein; and a plurality of rollers mounted to the carriage about a periphery of the circular aperture of the carriage, the rollers constructed and arranged to support the circular pan and to allow rotation of the pan thereon.

10. The container apparatus of claim 9, wherein the plurality of rollers are in contact with and travel within the support ring of the pan.

11. The container apparatus of claim 9, wherein the plurality of rollers comprise two front rollers having an axle with a retaining head mounted on the carriage and two back rollers having an axle capable of lateral movement in the direction of the axle mounted on the carriage.

12. The container apparatus of claim 9, wherein the first mounting bracket and the second mounting bracket each have at least one roller constructed and arranged to provide translational movement of the carriage thereupon.

13. A refrigerator comprising:

a cabinet having an interior compartment;

a plurality of mounting rails located in the interior;

a circular pan having a circumferential rim located at the top of the pan;

a first mounting bracket and a second mounting bracket, each bracket having at least one roller and an integral track formed therein;

a carriage having a circular aperture capable of accommodating the circular pan therein, the carriage including a first roller and a second roller constructed and arranged to travel on the integral track formed in the first mounting bracket and the second mounting bracket, respectively, to allow translational movement of the carriage therein;

a plurality of rollers mounted to the carriage about a periphery of the circular aperture of the carriage, the rollers constructed and arranged to support the circular pan and to allow rotation of the pan thereon; and a support ring located within the rim of the pan such that the plurality of rollers are in contact with and travel within the support ring of the pan.

14. A refrigerator of claim 13, wherein the first mounting bracket and the second mounting bracket have at least one roller each to provide translational movement of the carriage thereupon.

15. A refrigerator of claim 13, wherein the plurality of rollers comprise two front rollers having an axle with a retaining head removably mounted on the carriage and two back rollers having an axle capable of lateral movement in the direction of the axle removably mounted on the carriage.

16. A refrigerator of claim 13, wherein the plurality of rollers further comprise:

a rubber ring circumferentially mounted thereupon.

17. A refrigerator of claim 13, wherein the plurality of rollers are each mounted on an axle; and said carriage has a plurality of apertures that are structured to support and resiliently capture said roller axles.

* * * * *